United States Patent [19]

Washio et al.

[11] 3,950,090

[45] Apr. 13, 1976

[54] ELECTROPHOTOGRAPHIC COPYING MACHINE

[76] Inventors: Takaji Washio, 2-5-5, Okakaminomachi, Toyonaka, Osaka; Tatsuo Aizawa, 6-34, Kuwazu-cho, Higashisumiyoshi, Osaka, Osaka, both of Japan

[22] Filed: Nov. 26, 1973

[21] Appl. No.: 418,976

[52] U.S. Cl. ..... 355/8; 355/51

[51] Int. Cl.[2] ..... G03G 15/22

[58] Field of Search ..... 355/8, 14, 66, 13, 3 R, 355/50, 51, 3 SH

[56] References Cited

UNITED STATES PATENTS

| | | | |
|---|---|---|---|
| 3,424,526 | 1/1969 | Sacre | 355/66 X |
| 3,514,204 | 5/1970 | Trombetta | 355/14 |
| 3,609,032 | 9/1971 | Watanabe et al. | 355/66 X |
| 3,672,762 | 6/1972 | Suzuki et al. | 355/8 X |
| 3,677,637 | 7/1972 | Van Auken et al. | 355/51 X |
| 3,697,165 | 10/1972 | Morriston et al. | 355/8 |
| 3,704,944 | 12/1972 | Komori et al. | 355/8 |
| 3,738,743 | 6/1973 | Hoffman et al. | 355/3 |
| 3,741,642 | 6/1973 | Reick et al. | 355/8 |

*Primary Examiner*—L. T. Hix
*Assistant Examiner*—Kenneth C. Hutchison
*Attorney, Agent, or Firm*—A. Yates Dowell, Jr.

[57] ABSTRACT

An electrophotographic copying machine of the type in which the optical system is fixed in the machine frame, an original to be copied is placed on a moving support disposed at the upper portion of the machine frame and a sheet of electrophotographic copying paper is introduced, synchronously with the movement of the original, from a paper feed device to a passage for transport of copying paper to effect the copying operation; wherein during each copying cycle the support moves from a home position to a start of scanning position, reverses its direction to move during the scanning operation by a variable distance equal to the length of the copy to an end of scanning position, and returns to the home position.

8 Claims, 11 Drawing Figures

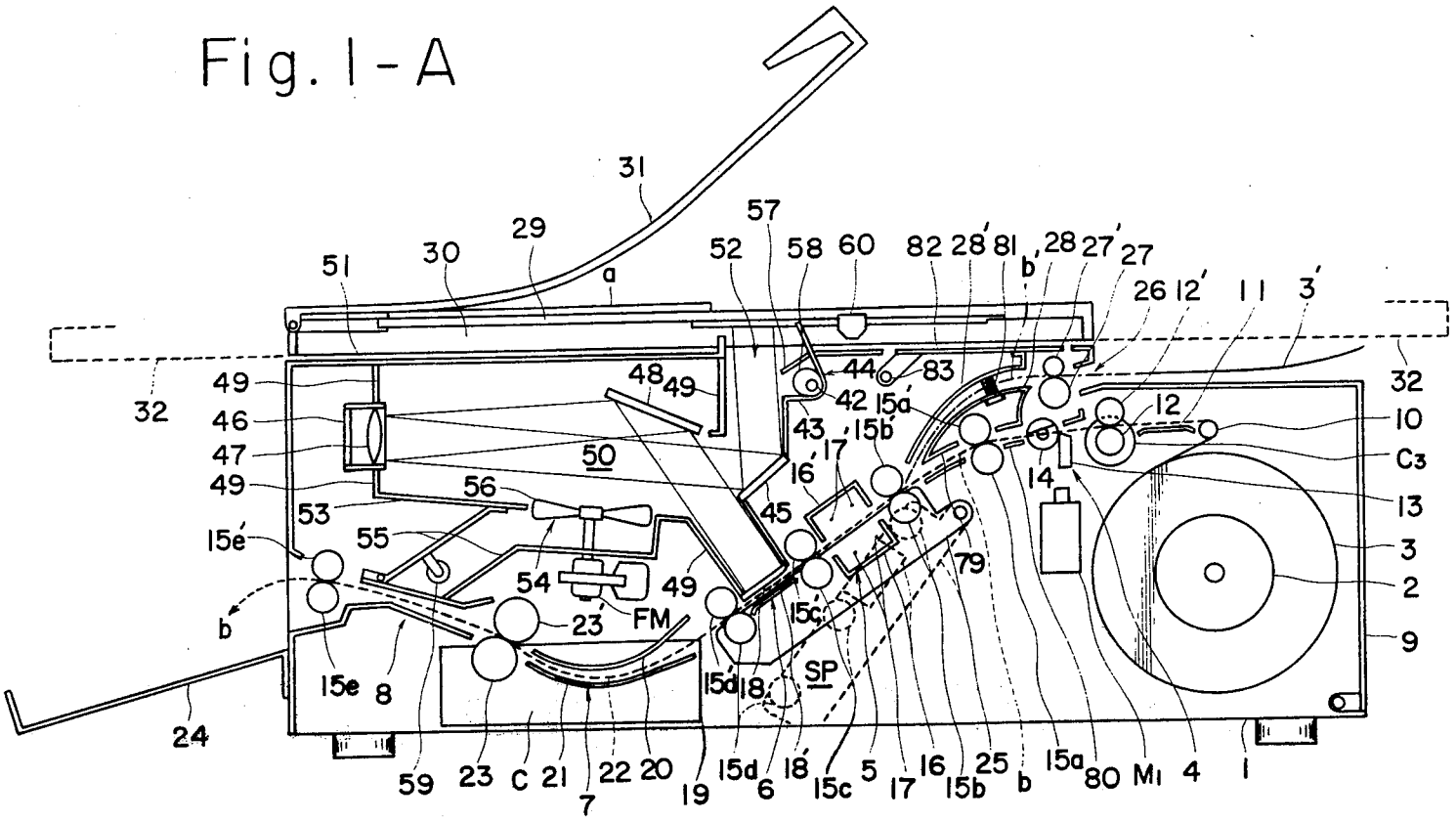
Fig. 1-A

Fig. 1-B
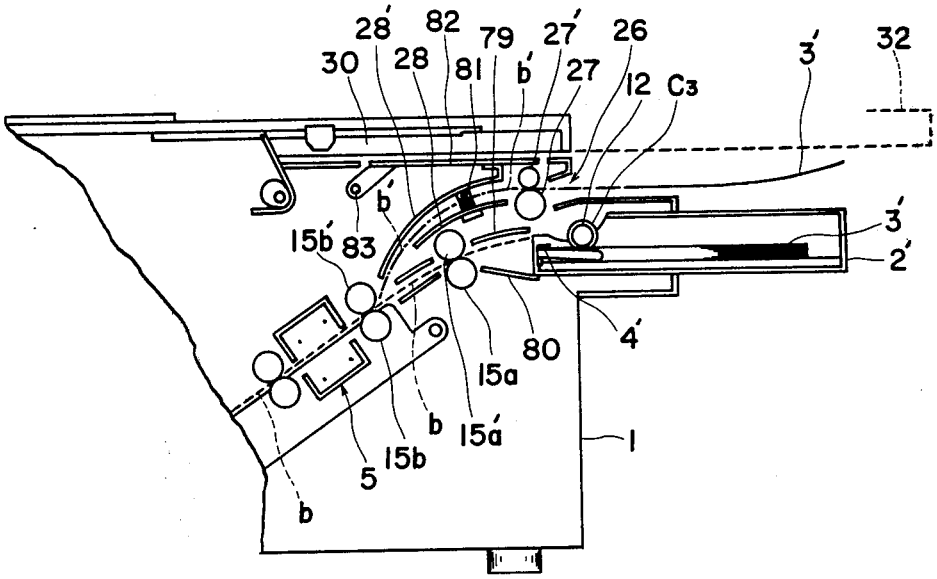

Fig. 2-A
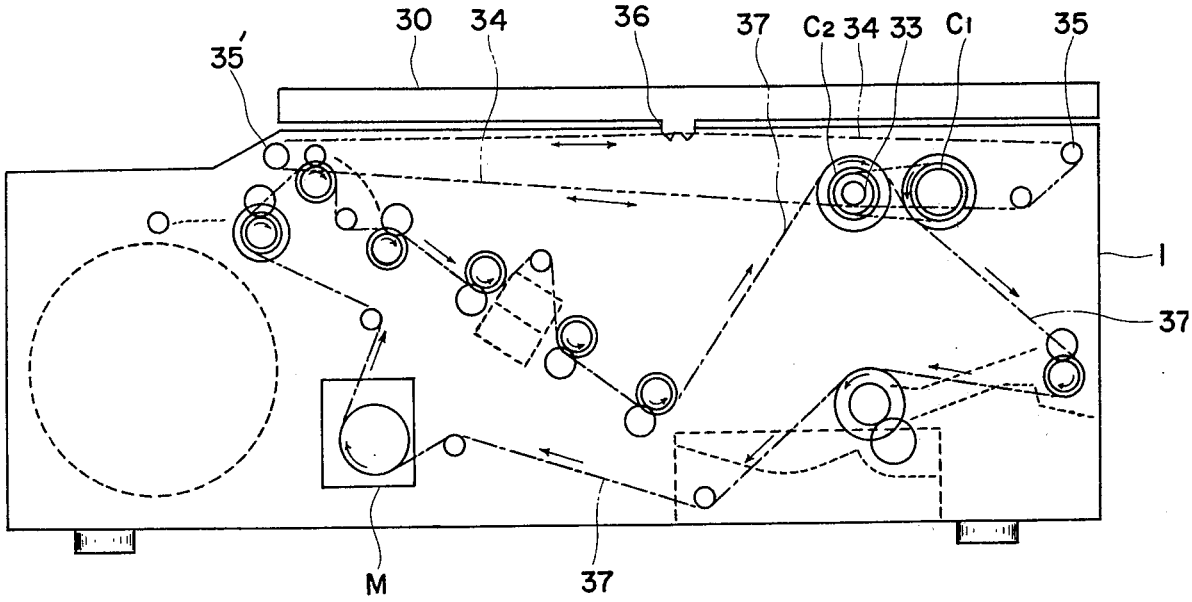

Fig. 2-B
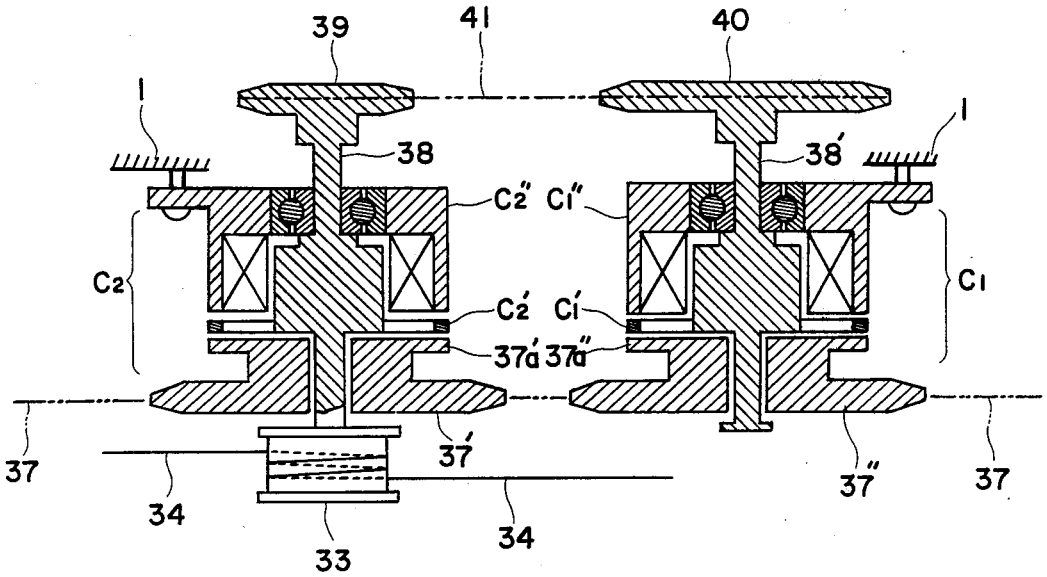

Fig. 3
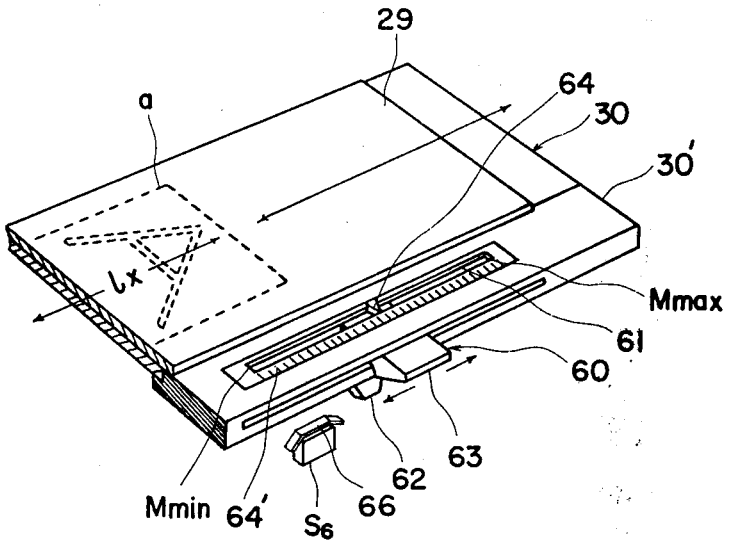
Fig. 4-B
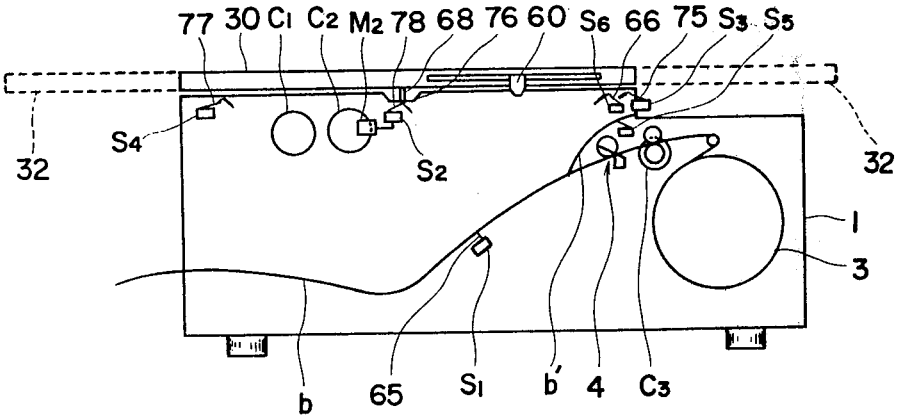

Fig. 4 - A
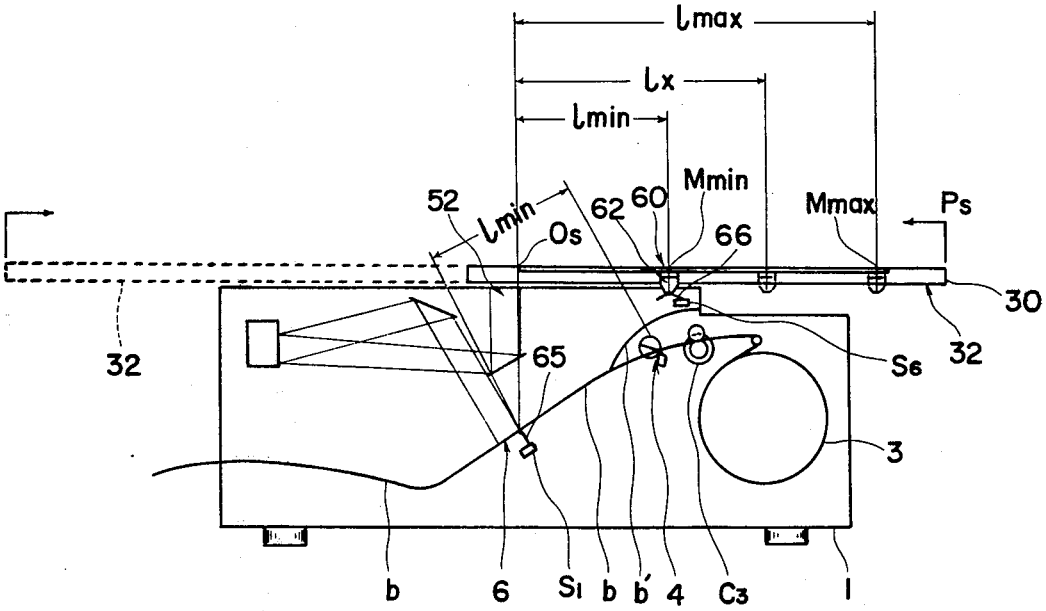
Fig. 4 - C
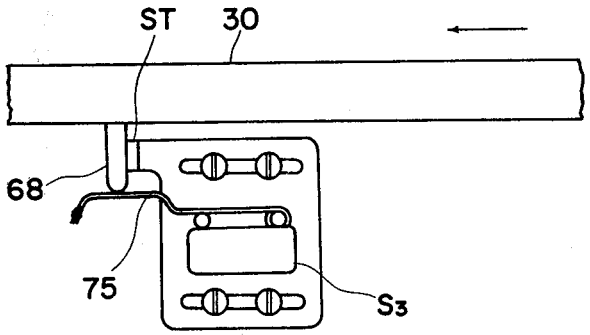

ELECTROPHOTOGRAPHIC COPYING MACHINE

This invention relates to an electrophotographic coyping machine of the type in which the optical system is fixed in the machine frame, an original to be copied is placed on a movable support disposed in the upper portion of the machine frame and an electrophotographic coyping paper is introduced, synchronously with the movement of the original, from a paper feed device to a passage for transport of copying paper to effect the copying operation.

In conventional electrophotographic copying machines of this type, when light exposure is conducted while moving the original and copying paper along respective passages, provision of a complicated synchronizing mechanism is necessary for ensuring the initiation of the movements of both the original and copying paper synchronously, and stable operation of this synchronizing mechanism cannot be attained without difficulties.

Furthermore, the moving support always travels a distance corresponding to the prescribed maximum size of copying paper regardless of the actual size of a copying paper actually used, and the light exposure step is not completed before the moving support travels along the entire distance corresponding to the prescribed maximum size of copying paper. Accordingly, the time required for obtaining one copy sheet is decided by this maximum light exposure length, and the moving support conducts a wasteful movement when a copy of a short original is made. Therefore, time is lost and the copying operation is not performed efficiently. This is a deficiency of the conventional copying machines of the above-mentioned type.

It is therefore a primary object of this invention to provide an electrophotographic copying machine in which when the light exposure is effected while moving an original to be copied and a copying paper along respective passages, initiation of the movements of both the original and copying paper can be completely synchronized by provision of a simple structure and the light exposure operation can be performed very efficiently and stably.

Another object of this invention is to provide an electrophotographic copying machine in which the light exposure travel course of the moving support can be shortened as the length of a copying paper used is short, to thereby obviate a wasteful movement of the moving support and increase the number of copy sheets to be obtained for a unit period of time, with the result that the copying operation can be performed very efficiently.

A further object of this invention is to provide an electrophotographic copying machine in which the scanning operation of the moving support is completed in a period of time depending on the length of a copying paper even when the mechanism for causing return travel is not actuated because of paper jamming or other trouble, by provision of a separate control mechanism of a simple structure which terminates the scanning operation automatically at or shortly after completion of the maximum light exposure travel course of the moving support and which starts the return travel immediately, whereby disorder or accident of the machine can be prevented.

A still further object of this invention is to provide an electrophotographic copying machine in which at the time of initiation of the coyping operation, the moving support is shifted from the home position just above the machine frame to the point of initiation of the light exposure step while a copying paper is introduced from the copying paper feed device to the transport passage; then the moving support is driven forwardly from the point of initiation of the light exposure step and is moved along the light exposure travel course synchronously with the movement of the copying paper; the light exposure step is completed depending on the length of the copying paper and the moving support is immediately driven rearwardly to initiate the return travel, to thereby obviate wasteful movement of the moving support in the light exposure step; at the time of completion of the entire copying operation, the moving support is restored and restrained at the above-mentioned home position, and the movements of an original to be copied and the copying paper travelling along respective transport passages are completely synchronized with each other, whereby the copying operation can be performed without loss of time, the length of the copying machine can be shortened, and the copying machine can be made compact to reduce the manufacturing cost; and in which the moving support is always restrained at the home position overlying the machine frame without projecting therebeyond while the machine is not operated, whereby the transportation, installation and storage of the machine can be greatly facilitated.

A still further object of this invention is to provide an electrophotographic copying machine in which the moving support for the original is prevented from overrunning the stop point when the copying operation is completed or the moving support is prevented from moving freely when the electric source for the machine is turned off, whereby the movements of the moving support and copying paper for the light exposure step can be completely synchronized and occurrence of troubles can be prevented completely.

A still further object of this invention is to provide an electrophotographic copying machine of the type in which an original to be copied is positioned on a movable carriage or support disposed at the upper portion of the machine frame and a roll-like copying paper is unwound from a feed reel and introduced into a transport passage in the machine and in which the original and copying paper are fed to the light exposure zone of an optical system at a synchronized speed, wherein the coyping paper is cut into a length corresponding to optimal length of the original and the return travel of the moving support is initiated in correspondence to said optimal length of the original. This makes it possible to avoid waste of copy paper and waste of time for non-useful movements of the original document carriage.

A still further object of this invention is to provide an electrophotographic copying machine of the random-cut and random-return type in which copying paper is used wastelessly and effectively and the copying operation can be performed rapidly depending on the light exposure length of an original to be copied.

A still further object of this invention is to provide an electrophotographic copying machine which comprises a plurality of copying paper feed passages, such as a sheet-like copying paper passage and a roll-like copying paper passage, in which each of these copying paper passages is disposed freely dismountably so that inspection of the machine and removal of jamming paper can be greatly facilitated.

A still further object of this invention is to provide an electrophotographic copying machine which comprises a downwardly directed development passage in a copying paper transport passage, wherein the tendency of paper jamming is greatly reduced at the introduction and discharge parts of the development passage.

A still further object of this invention is to provide an electrophotographic copying machine in which a passage for transport of copying paper is contained in a very compact machine housing and when paper jams, the jammed paper can be easily removed from the machine by opening this transport passage.

A still further object of this invention is to provide an electrophotographic copying machine which comprises an apparatus of a simple structure which can cool effectively a light-projecting apparatus, an optical system and a transparent plate for supporting thereon an original to be copied.

The foregoing and other objects and advantages will be apparent from the description given hereinafter.

SUMMARY OF THE INVENTION

The present invention provides a photographic copying machine including a frame having a transport passage for guiding copying paper past a cutter and through a corona discharge device, an exposure zone, a development zone, and a fixing and drying zone.

The original is placed on a carriage which is movable across the top of the frame past a light viewing window of the exposure zone and such carriage has a home position directly above the frame thereby avoiding projections forwardly and rearwardly of the frame. The carriage home position is between the extreme forward and extreme rearward positions and the carriage is stopped and latched in such home position by a spring pressed latch or stop.

Suitable controls are provided for lighting the exposure lamp and releasing the stop causing the copy paper to be fed forward in the transport passage toward the exposure zone simultaneously with the reverse movement of the original carrying carriage from the home position to the position for beginning viewing of the leading edge of the original whereby the lamp for exposure reaches its full brilliance by the time the leading edge of the original document on the carriage reaches the viewing window and the leading edge of the copy paper reaches the zone of exposure.

The carriage for the original document has means to adjust the extent of forward movement in the exposure direction in accordance with the length of an image position of the original desired to be copied.

A cutter is arranged to cut off the copy paper from a reel supply at the point indicated by an adjustment of the length of feed on the carriage.

All of these functions are performed automatically upon initiation of the cycle of operation which cycle of operation is controlled by a first switch engaging the leading edge of the copy paper and various other switches, relays and delay circuits and the like which are operated by lugs on the carriage.

The invention also provides for feeding individual sheets of copy paper either manually or automatically and saving time in accordance with a desired image length on the original and therefore the present invention provides for rapid copy making in a minimum of time, in both the reel fed and the individual sheet fed, but the reel fed copy paper form also saves copy paper, since the developed copy sheet from the reel feed is exactly the length desired of the image portion of the original document.

FIG. 1-A is a sectional side view illustrating arrangement of mechanism and members of an embodiment of the electorophotographic copying machine of this invention;

FIG. 1-B is a partially cut-out, sectional side view illustrating a paper feed zone of another embodiment of the electrophotographic copying machine of this invention;

FIG. 2-A is a side view illustrating a drive system of the copying machine shown in FIG. 1-A;

FIG. 2-B is a side view illustrating switch means for switching over the moving support of the copying machine of this invention;

FIG. 3 is a perspective view illustrating a mechanism for determining the light exposure range and the cutting length of a copying paper in the copying machine shown in FIG. 1-A;

FIG. 4-A and 4-B are views illustrating arrangement of detecting mechanisms in the copying machine of FIG. 1-A, FIG. 4-A showing especially the random cut system; and FIG. 4-B showing especially a mechanism for setting the position for initiation of the light exposure step;

FIG. 4-C is a side view illustrating a mechanism for setting the position for initiation of the light exposure step;

Figure 5:
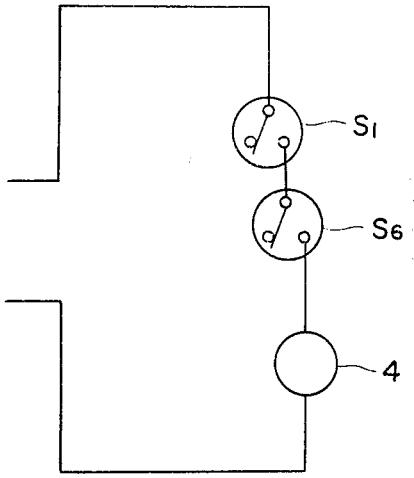
FIG. 5 is a simplified diagram showing the wiring circuit for actuating a copying paper cutting mechanism.

In the accompanying drawings, members having the same function are indicated by common reference numbers.

An embodiment of the electrophotographic coyping machine of this invention in which roll-like copying paper is automatically fed is illustrated in FIG. 1-A. In this embodiment, in the interior of a machine frame there is provided a passage *b* for transport of an electrophotographic copying paper which includes a feed reel 2 on which roll-like copying paper 3 is wound, a zone 4 of a copying paper cutting device, a zone 5 of a charging device, a light exposure zone 6, a zone 7 of a developing device zone and a zone 8 of a drying or fixing device, these zones being disposed in the order recited above.

The feed reel 2 is supported removably and rotatably on one side portion of the machine frame 1, namely on the right side portion in the drawing. The feed reel 2 can be easily taken out of the machine after opening an optionally openable lid 9 mounted on the right end wall of the machine frame 1. A guide roller 10 is mounted above the feed reel 2 to introduce roll-like copying paper 3 from the reel 2. A guide plate 11 and a pair of driven feed rollers 12 and 12' provided with a feed clutch C3 to be actuated at initiation of the copying operation are disposed between this guide roller 10 and the copying paper cutting device zone 4.

The copying paper cutting device zone 4 includes a fixed blade 13 and a rotary blade 14. The rotary blade 14 is rotated by means of a cutter solenoid M1, whereby copying paper 3 passing between the fixed blade 13 and rotary blade 14 is cut. On the discharge side of the cutting device zone 4, there are disposed a pair of continuously driven rollers 15*a* and 15*a'* to transport copying paper 3. The charging device zone 5 includes two confronting shields 16 and 16' disposed between a pair of drive rollers 15*b* and 15*b'* and another pair of drive rollers 15*c* and 15*c'*, containing corona discharge electrodes 17 and 17'. The light exposure zone 6 comprises a transparent plate 18 for light exposure of copying paper 3 disposed between a pair of drive rollers 15*c* and 15*c* and another pair of drive rollers 15*d* and 15*d'* and a guide plate 18' for guiding the copying paper to the transparent plate 18 and pressing it against plate 18.

A developing device zone indicated as a whole by numeral 7 is disposed on the discharge side of a drive rollers 15*d* and 15*d'*, and this development device zone 7 comprises a tank 19 for storing a liquid developer *c*, an upper curved guide member or tray 20 mounted in the upper portion of the tank 19 and a lower guide member or tray 21. A developing passage 22 is formed between the upper and lower guide members 20 and 21, through which copying paper 3 is allowed to advance. The liquid developer *c* in the tank 19 is drawn up into the upper tray 20 by means of a pump (not shown) and flows into the developing passage 22 to effect the development. On the discharge side of the developing passage 22, a pair of squeeze rollers 23 and 23' are mounted to remove the excess of the liquid developer from the copying paper. A drying or fixing device zone 8 including, for instance, an introducing guide plate, is disposed on the discharge side of the squeeze rollers 23 and 23'. A pair of withdrawal rollers 15*e* and 15*e'* are mounted on the discharge side of the drying or fixing device zone 8 to withdraw the copying paper from the machine interior onto a receiver 24.

In the electrophotographic copying machine of this invention, the developing passage 22 for contacting the copying paper with a liquid developer is so disposed that it has an upwardly curved form, and the passage 22 is fitted on the bottom of the machine frame 1 or in the vicinity of the bottom of the machine frame 1 freely dismountably, optionally together with the developer storing tank 19. The copying paper transfer passage *b* is so inclined with respect to the horizontal direction that the inclination of the transfer passage in the charging device zone 5 and light exposure zone 6 and the inclination of the transfer passage in the drying or fixing device zone 8 are substantially in the tangential direction of the developing passage 22 on the feed side and the tangential direction of the developing passage 22 on the discharge side, respectively.

The charging device zone 5 and light exposure zone 6 are defined by members 15*b*, 16, 17, 15*c*, 18' and 15*d* disposed below the transfer passage *b* and members 15*b'*, 16', 17', 15*c'*, 18 annd 15*d'* disposed above the transfer passage *b*. The upper members are fixed on the machine frame, and the lower members 15*b*, 16, 17, 15*c*, 18' and 15*d* are attached to a frame member 25 which is mounted on the machine frame freely openably and closably, preferably with the copying paper introducing side being the pivot axis. The inclination of the transfer passage *b* in the charging device zone 5 and light exposure zone 6 gives a space SP sufficient for the frame member 25 to open and close. In case the above-mentioned structure is adopted for the copying paper transfer passage, transport of copying paper can be smoothly performed without any hindrance at introduction and discharge parts of the developing zone where paper jamming tends to occur most frequently, and therefore, the frequency of occurrence of paper jamming can be reduced greatly as compared with the case of conventional electrophotographic copying machines of the wet development type. Moreover, even when paper jamming or other trouble occurs, since passages of the charging, light exposure and developing zone through which copying paper travels can be freely opened, inspection of these passages and removal of jamming paper can be accomplished very easily.

Since the transfer passage *b* is disposed so that it extends inclinedly from the introduction side of the developing zone, a pair of drive rollers 12 and 12' provided with a paper feed clutch C3, the copying paper cutting device 4 and a pair of copying paper transfer drive rollers 15*a* and 15*a'* are disposed in the upper portion of the machine frame 1.

In the case of a copying machine of the type in which sheet-like copying papers are automatically fed, modifications are made to the above-mentioned copying machine of the type in which roll-like copying paper is automatically fed. More specifically, as is illustrated in FIG. 1-B, a container 2' for sheet-like copying papers 3' is mounted on one end of the machine frame 1. This container 2' includes a nail 4' disposed at the end portion of the container 2' to prevent feeding a plurality of sheet-like copying papers 3' at one time.

The copying paper container 2' is fitted preferably dismountably on one end of the machine frame 1 and the forward end of a sheet-like copying paper 3' contained in the container 2' is determined by the nail 4'. A driven paper feed roller 12 equipped with a paper feed clutch C3 to be actuated at initiation of the copying operation is disposed above the container 2' in a manner such that the feed roller 12 has a pressing contact with the sheet-like copying paper 3'. A pair of copying paper transfer rollers 15*a* and 15*a'* are disposed on the discharge side of the roller 12. Each of members and devices disposed in the copying paper transfer passage *b* has the same structure and function as in the copying machine shown in FIG. 1-A. Accordingly, explanation of these members and devices are omitted.

In electrophotographic copying machines shown in FIGS. 1-A and 1-B, in order to enable the manual feeding of a sheet-like paper in addition to the automatic feeding of roll-like copying paper 3 or sheet-like copying paper 3', there is provided an inlet 26 for feeding sheet-like copying paper 3' is provided in the upper portion of the machine frame 1, and a pair of drive rollers 27 and 27' for feeding sheet-like copying paper 3' and confronting guide plate 28 and induction plates 28' defining a passage for sheet-like copying paper 3' are disposed between the paper feed inlet 26 and a pair of drive rollers 15*b* and 15*b'* positioned on the introduction side of the charging device zone 5. Thus, on the introduction side of the charging device zone 5, a passage *b'* for transfer of manually fed sheet-like paper 3' is formed independently from the passage *b* for transfer of automatically fed roll-like copying paper 3 or sheet-like copying paper 3'.

In the case of a copying machine of the type in which only manual feeding of sheet-like copying paper is conducted, provision of an automatic paper feed mechanism and the paper transfer passage *b* from the paper feed mechanism to the drive rollers 15*a* and 15*a'* disposed on the introduction side of the charging device zone 5, which both the manual paper feeding and the automatic paper feeding are possible, can be omitted. In other words, it is sufficient that only the above-mentioned passage *b'* for transfer of manually fed copying paper is provided.

In the electrophotographic copying machine of this invention, a guide plate 80 is attached to the machine frame 1 to define the lower face of the passage *b* for transfer of automatically fed copying paper, and a passage-forming middle member having an integrated structure comprising on the upper face a guide plate 28 defining the lower face of the passage *b'* for transfer of manually fed sheet-like copying paper and on the lower face an induction plate 79 defining the upper face of the passage *b* for transfer of automatically fed copying paper, is disposed above the guide plate 80 and fitted dismountably to the machine by means of, for instance, screws 130, so that a prescribed distance is formed between the induction plate 81 and the guide plate 79. Further, a passage-forming upper member having an integrated structure comprising on the lower face an induction plate 28' defining the upper face of the passage *b'* for transfer of manually fed copying paper and constituting on the upper face a part 82 of the upper face of the machine housing, is disposed above the above-mentioned passage-forming middle member and is fitted freely openably and closably at one end thereof, for instance, by means of a shaft 83 on the machine frame 1 so that a prescribed distance is formed between the induction plate 28' and guide plate 28. When these guide plates are dismounted, the passage *b* for transfer of automatically fed copying paper or the passage *b'* for transfer of manually fed sheet-like copying paper can be readily opened and hence, inspection of paper jamming or removal of jamming paper can be performed with ease.

Above the machine frame 1 having a light exposure opening 52 on the upper surface thereof, there is provided a moving support or carriage 30 having a transparent plate 29 for supporting thereon an original *a* to be copied. A pressing plate 31 is mounted on the moving support 30 to press the original *a* to the transparent plate 29. The moving support 30 is fitted on the upper portion of the machine frame 1 through guiding members such as rollers (not shown) so that it can move reciprocatively in the horizontal direction, and the moving support 30 is driven by a moving support drive mechanism capable of switching over the moving direction reversely and it makes a reciprocative movement in a path of movement or passage 32. For instance, a combination of a drive drum 33 which is driven and rotated in normal and reverse directions and a wire 34, such as shown in FIG. 2-A, can be used as the moving support drive mechanism capable of switching over the moving direction reversely. The wire 34 is wound on the drive drum 33. One end of the wire 34 is fixed to a wire fitting member 36 of the movable carriage or support 30 through a pulley 35 rotatable on one end of the machine frame 1 and the other end of the wire 34 is also fixed to the wire fitting member 36 of the moving support 30 through a reel 35' pivotted on the other end of the machine frame 1. As is illustrated in FIG. 2-B, electromagnetic clutch mechanisms C1 and C2 having, respectively, sprockets 37'' and 37' driven by a drive chain 37 are mounted on the machine frame 1. A rotary disc C2' of the electromagnetic clutch mechanism C2, the drive drum 33 and the sprocket 39 are fitted on one shaft 38, while a rotary disc C1' of the electromagnetic clutch mechanism C1 and the sprocket 40 are fitted on the other shaft 38'. A chain 41 is provided between sprockets 40 and 39, and both the shafts 38 and 38' are rotated in the same direction with the proviso that the rotation speed of the shaft 38 is higher than the rotation speed of the shaft 38'. When, by actuation of a switch-over mechanism, an electric current is applied to the electromagnetic clutch mechanism C2 and the electromagnetic clutch mechanism C1 is kept in the open state, the rotary disc C2' is bonded to a clutch plate 37*a'* of the sprocket 37' by a magnetic force, and therefore, the drive drum 33 is rotated in the same direction as the sprocket 37' to thereby move the moving support 30 for the light exposure step. At this time, also the shaft 38' is rotated through sprocket 39, sprocket 40 and chain 41, but the sprocket 37'' is in the released or idle state with respect to the shaft 38' because the electromagnetic clutch mechanism C1 is kept in the open state. When the actuation of the switchover mechanism is set free, an electric current is applied to the electromagnetic clutch mechanism C1 and the electromagnetic clutch C2 is kept in the open state, whereby the sprocket 37'' rotated in the direction opposite to the rotation direction of said sprocket 37' and the shaft 38' are bonded to each other by an action of the clutch C1 and the drive drum 33 is rotated in the direction opposite to the rotation direction in the above case at a higher speed than in the above case through sprocket 40, chain 41, sprocket 39 and shaft 38, with the result that the wire 34 is so driven as to effect the return travel of the moving support 30. Like the sprocket 37'' in the above case, the sprocket 37' is kept in the released or idle state with respect to the shaft 38.

The switch-over of the direction of the reciprocative movement of the moving support 30 is accomplished in the above-mentioned manner. The speed of the return travel of the moving support can optionally be made higher than the speed of the moving support during the course of the light exposure step by changing appropriately gear numbers of sprockets 40 and 39. Instead of the combination of the above-mentioned drive drum 33 and stretching wire 34, a plurality of drive rollers equipped with electromagnetic clutches and rotated in directions opposite to one another may be disposed so as to move the moving support 30 in the horizontal direction reciprocatively.

To return to FIG. 1-A, an optical system is mounted between the copying paper transfer passage *b* and the moving passage 32 for the moving support 30 in the state fixed in the machine frame 1 so as to connect optically the light exposure zone 6 of the copying paper transfer passage *b* with the transparent plate 29 of the moving support 30 and focus an image of an original *a* to be copied on a copying paper 3 travelling along the transfer passage *b*. This optical system comprises a light projecting device 44 provided with a light source 42 and a reflection wall 43, a reflection mirror 45, a lens 47 provided with an in-mirror 46, a reflection mirror 48, and a lens housing 49 supporting a transparent plate 18 for light exposure of copying paper. This optical system is so constructed that a light emitted from the light source 42 and reflected on the original *a* passes through reflection mirror 45, lens 47, in-mirror 46, and reflection mirror 48 and arrives at the copying paper light exposure transparent plate 18 to focus thereon the image of the original *a*.

The lens housing 49 and light projecting device 44 are so disposed that they form an independent chamber 50 in the interior of the copying machine. The upper end portion of the reflection wall 43 of the light projecting device 44 and the top end portion of an upper wall 51 of the lens housing 49 are projected upwardly so that a slit of a minute distance is formed between these end portions and the moving support 30, and an opening or document viewing window 52 for light exposure of the original *a* is formed between the upper end portion of the reflection wall 43 and the top end portion of the upper wall 51 of the lens housing 49. An opening 54 and an air duct 55 extending to the drying or fixing guide plate 8 of the copying paper transfer passage *b* are mounted on a lower wall 53 of the lens housing 49. A suction fan 56 driven by a fan motor FM is provided at the portion where the opening 54 is disposed. When the optical system is confined in a substantially closed chamber 50 in the above mentioned manner with a slit left between the optical system and the transparent plate 29 of the moving support 30 and a fan 56 is mounted on the lower wall 53 of this chamber 50, cool air passes through a passage formed between the upper portion of the machine frame 1 and the lower surface of the transparent plate 29 of the moving support and introduced into the optical system chamber 50 through the light exposure opening, whereby the transparent plate 29 supporting thereon the original to be copied is cooled. Further, when a heat-absorbing glass 57 is mounted in the interior of the light projecting device 44 with a slit-like opening being left before the light source tube lamp 42 and an opening 58 is formed on the side plate of the machine frame 1 supporting the light source tube 42, cool air is flown from the outside of the machine around the periphery of the light source tube 42 to cool it and then it is introduced into the optical system chamber 50. Air heated by the heat exchange with the original-supporting transparent plate 29 and the light source tube 42 is sucked by the fan 56 and introduced to the drying or fixing device zone 8 of the copying paper transfer passage *b* through the air duct 55 to heat the developed copying paper coming from the developing device zone 7. It is possible to provide a heating device 59 in the interior of the air duct 55 so as to give a further heat necessary for drying of the copying paper to the hot air discharged from the lens housing 49.

In the electrophotographic copying machine of this invention, at the time of initiation of the copying operation, the switch mechanism for initiation of the copying operation is actuated to initiate the copying step and drive paper feed rollers 12 and 12', whereby roll-like copying paper is unwound from the feed reel 2. In the embodiment shown in FIG. 1-B, when the switch mechanism for initiation of the copying operation is actuate to initiate the copying step, a paper feed roll 12 is driven to feed a sheet-like copying paper 3' from a container 2'. In case a sheet-like copying paper is manually fed, the sheet-like copying paper 3' is manually inserted into a feed opening 26, whereby the switch mechanism for initiation of the copying operation is actuated to initiate the copying step. The so fed copying paper 3 or 3' is transferred through drive rollers 15*a* and 15*a'* which are always driven during the copying operation and introduced between drive rollers 15*b* and 15*b'* of the charging device zone 5. Thus, the copying paper 3 or 3' is fed between corona discharge electrodes 17 and 17' on which a high electric potential is applied. Corona discharge from the 17 and 17' is applied on the running copying paper, whereby the photoconductive layer of the copying paper is uniformly statically charged. The so statically charged copying paper is introduced between drive rollers 15*c* and 15*c'* and fed between a transparent plate 18 for light exposure of copying paper and a guide plate 18'. The movement of the copying paper below the light exposure transparent plate 18 is synchronized with the movement of an original *a* on a light exposure opening 50, which is moved in the state supported on a transparent plate 29 of a moving support 30. Thus, the image of the original *a* to be copied is focused on the uniformly statically charged photoconductive layer of the copying paper 3 or 3', whereby a latent image corresponding to the image of the original *a* is formed on the photoconductive layer of the copying paper 3 or 3'. The latent image-carrying copying paper is introduced into a development passage 22 by drive rollers 15*d* and 15*d'*, where it has a contact with a liquid developer *c* to thereby form a visible image corresponding to the latent image. The visible image-carrying copying paper 3 or 3' is fed between squeeze rollers 23 and 23' to remove excess of the liquid developer. Then, the copying paper is dried in a drying zone 8 by hot air fed from an air duct 55, and is discharged on a copy receiver 24 by means of withdrawal rollers 15*e* and 15*e'*.

In the electrophotographic copying machine of this invention, a restraint mechanism is disposed along the moving passage 32 of the moving support 30 to restrain the movement of the moving support 30 at the stop point or home position just above the machine frame, and specific detecting mechanisms are disposed along the copying paper transport of transfer passage *b* and the moving passage 32 of the moving support or carriage 30, respectively, so that the initiation and termination of the light exposure preparation step, the initiation and termination of the light exposure step and the initiation and termination of the return travel can be accomplished in the moving support 30 through switch mechanisms actuated by such detecting mechanisms.

More specifically, in the case of the electrophotographic copying machine shown in FIG. 1-A, as is illustrated in FIG. 3, a mechanism 60 for determining the light exposure range and corresponding copying paper cutting length is mounted on the side edge portion 30' of the moving support 30 to determine an optimally light exposure range in accordance with the length of the original *a* to be copied and a corresponding copying paper cutting length. This determining mechanism 60 can be moved along said side edge portion 30' so that the light exposure range length or copying paper cutting length *lx* will be optionally chosen within a range of from a minimum light exposure range length or copying paper cutting length *l*min to a maximum light exposure range length or copying paper cutting length *lmax*. In order to embody this feature, for instance, a groove-like hole 61 is formed on the side edge portion 30' of the moving support 30 and the determining mechanism 60 is fitted in said groove-like hole 61. The determining mechanism 60 comprises a convex part 62 for pressing push pieces of switches disposed on the moving passage of the moving support 30, a handle 63 for moving the determining mechanism 60, and an indicator 64 for deciding the operation range of the determining mechanism 60 according to a scale 64' graduated from a minium light exposure range length mark Mmin to a maximum light exposure range length mark Mmax.

In case a copy having a size equal to an original is obtained, as illustrated in FIG. 4-A, on the copying paper transfer passage b a copy paper detecting mechanism comprising a copy paper detecting switch S1 and a an operating lever or push piece 65 of said switch S1 is disposed at the point or in the vicinity of the introduction or receiving end of the light exposure zone 6 and is spaced in the direction of the movement of the copying paper from the actuation point of the copying paper cutting device 4, namely the point of initiation of the copying paper transfer, by a distance corresponding to the prescribed minimum cutting length *lmin* (minimum light exposure range length). The push piece 65 detects the forward end of the running copying paper to actuate the switch S1 and the switch S1 is kept closed while the copying paper is moving with a pressing contact with the push piece 65. When the push piece 65 detects the rear end of the copying paper, the switch S1 is returned to the original open state.

Mechanisms known as detecting mechanisms, for instance, a photoelectric detecting mechanism, can also be used as the first detecting mechanism.

On the moving passage of the moving support 30, another detecting mechanism comprising a switch S6 and an operating lever or push piece 66 of said switch S6 is disposed. The push pieces 66 detects the above-mentioned determining mechanism 60 of the moving support 30 which is travelling along the passage or carriage path 32, to actuate the switch S6. Known detecting mechanisms, for instance, a photoelectric detecting mechanism, can also be used as such detecting mechanism.

As is illustrated in FIG. 4-A, this detecting mechanism is so disposed that when the moving support 30 is positioned at the point Ps of initiation of the light exposure step or start print position and the minimum light exposure range length min (minimum copying paper cutting length) is set in the determining mechanism 60 (when the indicator 64 shown in FIG. 3 indicates the minimum mark Mmin), the convex part 62 of the determining mechanism 60 is detected by its contact with the push piece 66. By establishing such positional relationship, it is made possible to cut the copying paper in a length corresponding to the length *lx* of the light exposure range of the original.

In case a copy having a size *n* times as large as the length of the original or a copy having a size corresponding to $1/n$ of the length of the original (*n* is a number greater than 1) is obtained, it will readily be understood that the copy paper detecting mechanism is disposed on the copying paper transfer passage *b* at a point spaced from the actuation point of the copying paper cutting device 4 by distance of $n \times l\min$ or $1/n \times l\min$ (in which *l*min indicates the minimum light exposure range length of the moving support), and that the copying paper is transferred at a speed $V_2$ of $n \times V_1$ or $1/n \times V_1$ (which $V_1$ is the running speed of the moving support).

Figure 7:
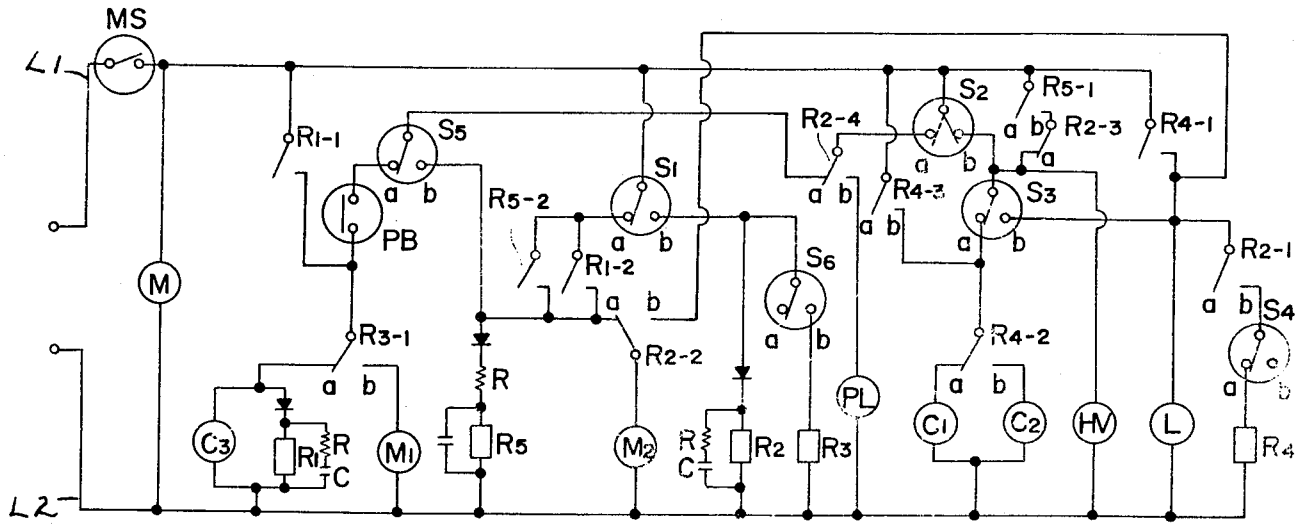
FIG. 7 is a circuit diagram illustrating an electric system in the electrophotographic copying machine of this invention.

In the electrophotographic copying machine shown in FIG. 1-A, as is illustrated in FIG. 5, the copying paper cutting device 4 is so arranged that it is actuated only when both the switches S1 and S6 are actuated, namely closed. For embodying this feature, as is illustrated in FIG. 7, switches S1 and S6 and relay R3 are connected to an electric source in series, and a normally open contact *b* of relay contact R3-1 of the relay R3 is connected in series to a cutter solenoid M1, and a paper feed clutch C3 is connected to a normally closed contact *a* of the relay contact R3-1. Thus, when the relay R3 is actuated to operate the cutter solenoid M1, passage of an electric current into the paper feed clutch C3 is stopped. Further, an off-delay relay R1 is disposed in parallel to the paper feed clutch C3 and a self-maintaining contact R1-1 of the relay R1 is connected in series to a common terminal of the relay contact R3-1, so that when the contact *a* of the relay contact R3-1 is opened and the contact *b* is closed, the relay contact R1-1 is kept in the closed state for a time necessary for keeping the cutter solenoid M1 in the actuated state. The common terminal of the relay contact R3-1 is connected to the electric source in series through normally closed contacts *a* of switch PB, switch S5, relay contact R2-4 of an off-delay relay R2 and switch S2.

The mechanism according to which the copying paper 3 is cut into a length *lx* corresponding to optimal light exposure range length *lx* of the original *a* to be copied will now be detailed by reference to FIGS. 4 and 5. The length determining mechanism 60 is set to the position of *lx*. At the time of initiation of the copying operation, the copying initiation switch mechanism PB is closed to actuate the paper feed clutch C3 to start the feeding of copying paper. The forward end of the copying paper reaches the introduction end of the copying paper light exposure zone and presses the push piece 65 of the copy paper detecting mechanism to actuate the copy paper detecting switch S1. At this moment, the distance between the forward end of the copying paper and the actuation point of the cutting device is equal to the length *lmin*, and the moving support 30 is positioned at the point of initiation of the light exposure step to actuate a rear stop switch S3. The forward end Os of the original to be copied which is placed on the moving support 30 and the forward end of the copying paper 3 are introduced from said points into respective light exposure zones at synchoronized speeds. While the copying paper 3 is passing through the light exposure zone 6, the copy paper detecting mechanism actuated and hence, the switch S1 is kept in the closed state. When the moving support 30 has travelled the distance of $(lx - lmin)$, the push piece 66 disposed on the moving passage 32 of the moving support 30 has a contact with the convex part 62 of the length determining mechanism 60 to thereby close the switch S6. As is illustrated in FIG. 7, when both the switches S1 and S6 are thus closed, the relay R3 is actuated to close the normally open contact b of the relay contact R3-1, whereby an electric current is passed through the cutter solenoid M1 and the copying paper 3 is cut. When the cutting of the copying paper is thus effected, the forward end of the copying paper 3 is spaced from the actuation point of the cutting device 4 by a distance of $l\min + (lx - lmin)$, namely a distance of *lx* as a whole. Accordingly, in the electrophotocopying machine of this invention, it is made possible to cut the copying paper 3 into a length corresponding to the optional light exposure range length *lx* of the original *a* to be copied. In short, random cutting of copying paper can be easily performed.

In the case of the electrophotographic copying machine shown in FIG. 1-B, provision of the determining mechanism 60 and the copying paper cutting device 4 is not necessary, but the copy paper detecting mechanism comprising a switch S1 and a push piece 65 of the switch is provided, and it is mounted on the copying paper transfer passage *b* as in the case of the electrophotographic copying machine shown in FIG. 1-A. Provision of the switch S6 is also used. In this embodiment, since the cutting length determining mechanism 60 is not provided, instead of the above-mentioned switch mechanism to be engaged with the determining mechanism 60 mounted on the moving passage 32 of the moving support, as the switch S6 there is disposed a switch which is so arranged that it is actuated together with the switch S3 by the push piece 75 when it detects the moving support 30 at the point Ps of initiation of the light exposure step or start print position of the moving passage 32. Alternatively, the switch S6 can be disposed on the transport passage *b* so that it can be actuated together with the switch S1 by the push piece 65 of the copy paper detecting mechanism.

What is important in this invention is that the copy paper detecting mechanism is mounted on the transfer passage *b* to detect the forward end of the copying paper running on the transfer passage and actuate the switch mechanism upon detection of the forward end of the copying paper and to detect the rear end of the copying paper and return the switch mechanism to the open state upon detection of the rear end of the copying paper, and that the operation point of the copy paper detecting mechanism and the forward end Os of the original to be copied which is placed on the moving support 30 positioned at the point Ps of initiation of the light exposure step are in agreement with the introduction ends of the light exposure zone 6 and the light exposure opening 52, respectively (this state is shown in FIG. 4-A), or the forward end of the running copying paper and the forward end Os of the original placed on the moving support 30 are in the vicinity of said introductions, respectively and the time required for the forward end of the copying paper to reach the introduction end of the light exposure zone 6 is equal to the time required for the forward end Os of the original to reach the introduction end of the light exposure opening 52.

In the electrophotographic copying machine of this invention, as is illustrated in FIG. 4-B, a carriage detecting mechanism includes a push piece 78 for actuating a second carriage detecting switch S2 mounted on the machine frame 1 is disposed in engagement with a projection lever 68 mounted on the moving support at the stop point or lower portion therof (the position indicated by a solid line) just above the machine frame 1.

The carriage 30 is shown in its "home" position in FIGS. 1 and 4-B which is the position intermediate its extreme front and rear positions. The rear position is shown in full lines in FIG. 4-A from which position copy exposure begins and the extreme forward position is shown in dotted lines in FIGS. 1-A and 4-B which show the limit of movement for the longest copy.

Figure 6:
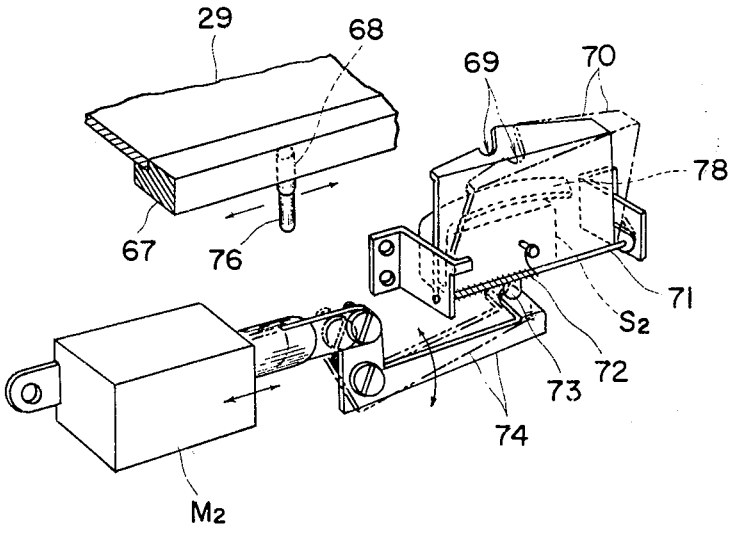
FIG. 6 is a perspective view illustrating a restraint mechanism for stopping a moving support for moving an original to be copied in the state placed thereon.

The carriage 30 is retained in its home position by the stop latch mechanism shown in FIG. 6. The carriage 30 has a lug or pin 68 having a downwardly extending tip 76 which engages a stop or pivoted latch plate 70 mounted on suitable brackets on the frame and pivoted about a hinge pin 71 and urged to its full line position by a spring 72 toward the path of movement of the lug or pin 68. The pivoted or hinged plate 70 has an inwardly extending flange providing a cam surface including a notch 69 adapted to embrace the pin tip 76 of the pin 68 to retain the carriage 30 in its home position shown in full lines in FIG. 4-B and the carriage is maintained in this home position without requiring electrical energy so the photocopy machine occupies a minimum of space for storage, transportation and use.

When a copy is to be made, the original *a* is placed on the transparent plate of the carriage 30 and the length indicator 60 is adjusted to the length of the desired image portion of the original document *a* to be copied and the push button PB is operated which starts the sequence of operations, the exposure lamp 42 being energized and also, the start solenoid M2 being energized releasing the latch 70 and causing the carriage 30 to be moved to its extreme rear position by the driving force of the reverse clutch C2 so the leading edge of the original *a* is in the position OS as shown in FIG. 4-A ready to start the exposure. The rearward movement of the carriage 30 gives the lamp 42 time to come to its maximum steady brilliance at the start of actual exposure of the copy paper by the image in the original as viewed through the viewing window 52.

At the same time that the carriage is moved rearwardly from its home position to locate the leading end of the original *a* at point OS, the copy paper from the roll 3 or a sheet from sheet supply 2′ is fed by means of feed rollers 12 and 12′ so the leading edge of the copy paper reaches the entrance end of the exposure zone 6 and actuates lever 65 closing switch S1 which energizes clutch C1 and advances the carriage 30 through the light exposure zone at the same rate as the copy paper so that the image of the original is formed on the sensitized copy paper.

The paper is cut by the cutter 4 upon actuation of the cutter switch S6 by the lug 62 carried by the length adjusting means 60 engaging the cam push piece 66 operating the switch S6. The feeding of the cutoff paper and the forward exposure movement of the carriage 30 continue until the copy paper passes the feel lever 65 opening the switch S1 and the forward movement of the carriage and copy paper continues until the trailing end of the cutoff copy paper section passes the exposure opening of the light path 6. The additional time for the trailing end of the copy paper to pass completely through the exposure zone being obtained by suitable electrical means hereinafter described in detail.

At the time of initiation of the operation of the carriage from its home position and beginning of feed of the copy paper, and the energization of the exposure lamp 42 and the rearward drive clutch C2, the stop or hinge latch plate 70 is withdrawn by solenoid M2 which operates link 74 moving the hinged piece or latch 70 to its dotted unlatched position of FIG. 6 thereby releasing the carriage 30 for movement. The start solenoid M2 remains energized during the movement of the carriage 30 from its home position to its extreme rearward position and through the actual exposure of the copy paper during forward movement of the carriage. The latch 70 is restored to its full line position by the spring after the carriage 30 has moved past the same during its forward movement so that when the carriage moves in a reverse direction from the point of complete exposure, the pin lug tip 76 engages in the notch 69 of the latch plate 70 as the spring 72 urges the latch plate into latched full line position of FIG. 6 thereby retaining the carriage in its home position. The tip 76 of pin 68 actuates switch S6 by engaging push piece or lever 78 shown in dotted lines in FIG. 6.

Thus, the engagement between the projecting pin 68 and the notch 69 is released only when the start solenoid M2 is actuated. The start solenoid M2 is electrically connected so that it is actuated at the time of initiation of the copying time to unlock the projection pin 68 of the moving support and that the start solenoid M2 is kept in the closed and actuated state during the light exposure preparation step and the light exposure step and it is returned to the open and unactuated state at the time of completion of the light exposure step. For instance, as is illustrated in FIG. 7, the start solenoid M2 is connected to the electric source through the normally open contact *b* of relay contact R2-2 of a relay R2 and relay contact R4-1 of a relay R4, and the normally closed contact *a* of the relay contact R2-2 is connected to the electric source in series with the normally open relay contact R1-2 of the relay R1 connected in parallel to the paper feed clutch C3 and the normally closed contact *a* of the switch S1. By adopting such electric circuit, the start solenoid M2 is kept actuated during a period from the time of initiation of the copying operation, namely from the time of actuation of the paper feed clutch C3 (when the relay contact R1-2 is closed) to the time of initiation of the return travel of the moving support 30 (when the relay contact R2-2 of the off-delay relay R2 is opened), and the starting solenoid M2 is returned to the open state at the time of initiation of the return travel, the hanging piece 70 allows the notch 69 to return to the position for engagement with the projecting pin 68 of the moving support 30, whereby the locking and stopping of the moving support 30 can be accomplished very effectively.

The start of the movement of the moving support 30 for the light exposure preparation (the movement in the direction reverse to the direction of the light exposure step) is delayed from actuation of the start solenoid M2 by a time necessary for releasing the engagement between the projecting pin 68 of the moving support 30 and the notch 69 of the hinged stop piece or latch 70. In order to embody this feature, an on-delay relay R5 is connected in parallel to the start solenoid M2, and a relay contact R5-1 is connected in parallel to the normally closed contact *b* of the switch S2. The normally closed contact *b* of the switch S2 is connected to a common terminal of a relay contact R4-2 so as to effect switch-over of an electric current between a clutch C1 for moving the moving support in the reverse direction and a clutch C2 for moving the moving support in the normal direction. At the copying operation, after the start solenoid M2 is actuated to unlock the moving support 30, the on-delay relay R5 is actuated, whereby an electric current is passed through the clutch C1 for moving the moving support 30 in the reverse direction via the normally closed contact *a* of the relay contact R4-2 and the reverse direction movement of the moving support (the movement of the light exposure preparation movement) is performed.

In the electrophotographic copying machine of this invention, a moving support setting device is mounted to adjust the position of the moving support for initiation of the light exposure step and to fix said position. As illustrated in FIG. 4-C, this setting device includes a detecting mechanism which is engaged with the projecting lever 68 mounted on the moving support 30 when the moving support 30 reaches the point Ps of initiation of the light exposure step to actuate the rear stop switch mechanism to stop the operation of the moving support-driving mechanism, and a stopper ST mounted to prevent the projecting lever 68 from overrunning the engagement position. This detecting mechanism comprises a rear stop switch S3 mounted on the machine frame 1 and a lever or push piece 75 of said switch S3. The position of this setting device can be freely adjusted and once the position is determined, the setting device can be fixed at this position.

By provision of this setting device, it is made possible to perform with each such adjustment that the point of actuation of the copy paper detecting mechanism comprising the switch S1 and the push piece 65 thereof and the position of the forward end Os of the original to be copied which is placed on the moving support 30 positioned at the point Ps of initiation of the light exposure step are in agreement with introduction ends of the light exposure zone 6 and the light exposure opening 52, respectively, or that the point of actuation of the first detecting mechanism and the position of the forward end Os of the original are set in the vicinity of said introduction ends of the light exposure zone 6 and light exposure opening 52, respectively and the time required for the forward end of the running copying paper to reach the introduction end of the light exposure zone 6 is equal to the time required for the forward end Os of the original on the moving support to reach the introduction end of the light exposure opening 52. Further, when this setting device is fixed after the above adjustment, the abovementioned positional relationship can be maintained for a long time stably without any disarrangement or disorder.

Instead of the above-mentioned detecting mechanism comprising a switch S3 and a push piece 75 of the switch S3, there can be used a known detecting mechanism, for instance, a photoelectric detecting mechanism.

In the electrophotographic copying machine of this invention, in the case of the automatic feeding of a roll-like or sheet-like copying paper, at the time of initiation of the copying operation, when a copying operation-initiating switch means (switch PB in FIG. 7) is actuated, the paper feed clutch C3 is actuated to feed copying paper 3 or 3' from the transfer-initiating position (at the position of the cutting device 4 in the case of a roll-like copying paper or at the position of the nail 4' for preventing feeding a plurality of copying papers in the case of a sheet-like copying paper) into the copying paper transfer passage *b*. Simultaneously, the relay R1 is actuated to close the relay contact R1-2, whereby the start solenoid M2 releases the restraint on the moving support 30 stopped at the stop point, and the on-delay relay R5 is actuated and the relay contact R5-1 is actuated with a delay of a time necessary for completion of unlocking of the moving support 30, whereby an electric current is applied to the reverse direction movement clutch C1 through the normally closed contact *a* of the relay contact R2-3, the normally closed contact *a* of the switch S3 and the normally closed contact *a* of the relay contact R4-2 and the movement of the moving support 30 from the stop point (the position indicated by the solid line in FIG. 1) just above the machine frame to the point of initiation of the light exposure step is initiated.

In the case of the manual feeding of a sheet-like copying paper, when a sheet-like copying paper 3' is inserted into the feed opening 26, it is caught between a pair of drive rollers 27 and 27' which are perpetually driven and simultaneously, the copying operation-initiating switch S5 is actuated to initiate the transfer of the copying paper 3' into the passage b' for manually fed copying paper. Accordingly, the position of initiation of the copying paper transfer falls on the actuation point of the switch S5. Since the start solenoid M2 releases the restraint of the moving support 30 simultaneously with actuation of the switch S5, the moving support 30 is driven and the on-delay relay R5 is actuated. Then, the light exposure preparation step of the moving support is initiated in the same manner as described above with respect to the case of the automatic feeding of copying paper.

As described hereinabove, the position Ps of initiation of the light exposure step is determined by the above-mentioned setting device. For accomplishment of the determination of said position Ps, the detecting mechanism comprising the switch S3 and the push piece 75 of the switch S3 is mounted on the moving passage 32 of the moving support 30 to detect the moving support 30 at the position Ps of initiation of the light exposure step and actuate the switch means to stop the operation of the moving support driving mechanism, and the projection lever 68 having a top end 76 on the lower side edge of the moving support 30 is similarly mounted. When the moving support 30 reaches the position Ps of initiation of the light exposure step, the tip end 76 of the projecting pin 68 presses the levers or push pieces 75 to actuate the switch means to stop the operation of the moving support driving mechanism and terminate the light exposure preparation step of the moving support 30. As the above switch means, there is adopted such a mechanism that the normally closed contact *a* of the switch S3 is connected in series with a relay contact R4-2 for effecting the switch-over of an electric current between the clutches C1 and C2 for reversing the direction of driving the moving support 30, so that the said normally closed contact *a* is opened by actuation of the switch S3 and application of an electric current to the clutches C1 and C2 is stopped.

In the electrophotographic copying machines of this invention, the time required for the moving support to travel from the stop point to the position of initiation of the light exposure step is made equal to, or shorter than the time required for the forward end of the copying paper to travel from the point of initiation of the paper transfer to the position of the detecting mechanism.

Accordingly, the moving support 30 which reaches the position of initiation of the light exposure step immediately initiates the travel of the light exposure step synchronously with the copying paper moving in the transfer passage, or it interrupts its movement at the position of initiation of the light exposure step for a while until the copying paper reaches the position for initiation of the light exposure step and it is then moved synchronously with the copying paper.

One of important feature of the electrophotographic copying machine of this invention is that the moving support 30 which has completed the light exposure preparation step and is located at the position Ps of initiation of the light exposure step which is always correctly set by the above-mentioned setting device is moved in the normal direction directly without provision of any timing-adjusting mechanism when the push piece 65 of the copy paper detecting mechanism mounted on the transfer passage *b* detects the forward end of the copying paper 3 or 3′ and actuates the copy paper switch means to operate the drive mechanism for driving the moving support in the normal direction, and the light exposure step of the moving support is thus initiated synchronously with the movement of the copying paper. As the above detecting switch means for embodying this feature, as is illustrated in FIG. 7, there is adopted such a mechanism that the common terminal of the relay contact R4-2 for effecting the switch-over of an electric current between the reverse direction movement clutch C1 and the normal direction movement clutch C2 is connected series with the normally open contact *b* of the relay contact R4-3 and the normally open contact *b* of the switch S3 is connected in series with the relay contact R2-1 and the relay R4.

The moment the moving support 30 completes the light exposure preparation step or while the moving support 30 is halted at the position of initiation of the light exposure step, the forward end of the copying paper 3 or 3′ presses the push piece 65 of the detecting mechanism to close the normally open contact *b* of the switch S1, whereby the off-delay relay R2 is actuated to close the relay contact R2-1 and an electric current is applied to the relay R4 through the contact *b* of the switch S2, the contact *b* of the switch S3 and the relay contact blade R2-1.

By actuation of the relay R4, not only the relay contact R4-3 but also the normally open contact *b* of the relay contact R4-2 is closed, whereby an electric current is applied to the normal direction movement clutch C1 through the relay contact R4-3 and the contact *b* of the relay contact R4-2 to initiate the light exposure step of the moving support 30 (the movement in the normal direction). Since the relay R4 has a self-maintaining contact R4-1, even after the contact *b* of the switch S3 is opened by the movement of the moving support 30 in the normal direction, passage of an electric current is maintained in the relay R4.

Another important feature of the electrophotographic copying machine of this invention is that the copying machine is so constructed that when the rear end of the copying paper 3 or 3′ passes through the position of the push piece 65 of the copy paper detecting mechanism, the switch S1 is opened and then the rear end of the copying paper 3 or 3′ passes through the light exposure zone, the driving direction of the drive mechanism for the moving support 30 travelling along the light exposure course is switched over, whereby the light exposure step of the moving support 30 is completed depending on the prescribed length *lx* of the light exposure range of the original *a* to be copied or the length *lx* of the copying paper and the return travel of the moving support 30 from this carriage return position is initiated.

As the switch means for embodying the above feature, there is adopted, for instance, such a mechanism that, as is illustrated in FIG. 7, the relay R2 is connected in series with the normally open contact *b* of the switch S1 through a rectifier a series circuit of a resistor R and a condenser C is connected in parallel to this relay R2, to thereby form an off-delay circuit for maintaining the actuation of the relay R2 until the rear end of the copying paper 3 or 3′ passes through the light exposure zone 6. Instead of this off-delay relay, it is of course possible to employ an ordinary relay in combination with normally open switch means or detecting mechanism (actuating piece) which can maintain the actuation of said relay while the forward end of the copying paper reaches the introduction end of the light exposure zone and the rear end of the copying paper departs from the discharge end of the light exposure zone. The moving support-driving means, namely the reverse direction movement clutch C1 (return travel clutch) and the normal direction movement clutch C2 (light exposure step clutch), are connected to the normally closed contact *a* and normally open contact *b* of the relay contact R4-2 of the relay R4, respectively. The relay R4 is connected in series with the relay contact R2-1 of the off-delay relay R2 on the side of the normally open contact *b*. In the above structure, by passage of the rear end of the copying paper 3 or 3′ through the actuation point of the push piece 65 of the switch S1, the relay R2 is opened, but by the off-delay action the relay contact R2-1 of the relay R2 is not opened before the rear or trailing end of the copying paper passes through the discharge end of the light exposure zone 6. The moment the relay R4 is opened, the normal direction movement clutch, namely the light exposure step clutch C2, is opened to terminate the light exposure step, and simultaneously, an electric current is applied to the reverse direction movement clutch, namely the return travel clutch C1, whereby the return travel of the moving support 30 is initiated. At this time, the relay contact R4-1 is also opened and the light source L for the light exposure is turned off.

According to this invention, in the above-illustrated manner, the random return system of the moving support in which the termination of the light exposure step and the initiation of the return travel are performed depending on the optional light exposure range length *lx* of the original *a* to be copied or the length of the copying paper can be established. By dint of this feature, in the copying machine of this invention the copying operation can be accomplished much more promptly than in known machines and the loss time can be completely obviated.

In the electrophotographic copying machine of this invention, it is possible for the return mechanism for the moving support 30 to operate independently from the above-mentioned random return mechanism, whereby even when the random return mechanism is not actuated by an accidental trouble (such as paper jamming or uncutting of roll-like copying paper), the termination of the light exposure step and initiation of the return travel of the moving support 30 can be automatically performed.

Such return mechanism will now be described by reference to FIG. 4-B. A detecting mechanism comprising a switch S4 and a push piece 77 of the switch S4 is mounted on the left side of the moving passage 32 of the moving support 30, so that when the tip end 76 of the projecting pin 68 mounted on the lower side edge of the moving support 30 presses the lever or push piece 77 of said switch S4, the light exposure step of the moving support is terminated also by this pressing and the return travel of the moving support is initiated. It is important that the switch S4 and its push piece 77 are disposed so that they can be actuated when the moving support travels to the variable carriage return position which is located the distance equal to, or a little longer than, the maximum light exposure length *lmax* of the original, from the position of initiation of the light exposure step or start print position.

Further, it is preferred that the normally open contact *a* of the switch S4 is inserted in the circuit of the above-mentioned relay R4 in series therewith (see FIG. 7).

When the above-mentioned return mechanism is provided, even if the switch S1 is not returned to the original open state but kept actuated by paper jamming or the like, by pressing of the tip end 76 of the projecting pin 68 against the push piece 77 of the detecting mechanism, both the switch S4 and the relay R4 are opened, and the relay contact R4-2 is returned to the open state, whereby an electric current is applied to the reverse direction movement C1 through the contact *b* of the switch S2, the contact *a* of the switch S3 and the contact *a* of the relay contact R4-2 and the return travel of the moving support is initiated. Further, the relay contact R4-1 is opened and the light source L for the light exposure is turned off. A known detecting mechanism, for instance, a photoelectric detecting mechanism can be used as the above detecting mechanism.

In the electrophotographic copying machine of this invention, as described above, when the rear end of the copying paper 3 or 3′ passes through the actuation point of the push piece 65 of the switch S1, the switch S1 is opened, whereby the light exposure step of the moving support 30 is terminated and simultaneously, the moving direction of the moving support is reversed and the return travel is initiated. At the same time, both the off-delay relay R2 and the relay contact R2-2 of the relay are opened, and since the switch S5 is opened at this moment in the case of the automatic feeding of roll-like or sheet-like copying paper or since the rear end of the copying paper has already passed through the switch S5 to open it in the case of the manual feeding of sheet-like copying paper, when the switch S6 is once closed, the relay R3 becomes closed and the relay contact R3-1 of said relay R3 is opened. Accordingly, the relay R1 is opened and since the relay contact R1-2 has already been opened, application of an electric current to the start solenoid M2 to which a drive force for releasing the restraint on the moving support by the restraint mechanism is given is stopped.

By stopping application of an electric current to the start solenoid M2, the hinged piece 70 is caused to return its notch 69 to the position for engagement with the projecting lever of the moving support 30, whereby the moving support 30 on the return travel is stopped assuredly at the stop point without over-running and it is automatically restrained at this stop point in the state ready for the next copying operation.

In the electrophotographic copying machine of this invention, since the restraint of the moving support by the restraint mechanism is accomplished by stopping application of a drive force for releasing said restraint, the moving support is not released from the restraint even when the electric source for the machine is opened, and therefore, the restraint of the moving support can be accomplished effectively and it can be prevented from moving freely even when the electric source for the machine is opened.

In order to prevent occurrence of continuous jamming of copying paper, in the copying paper transfer passage *b*, a switch S2 having a push piece 78 is disposed on the moving passage 32 of the moving support 30 so that in case the moving support 30 is at the stop point, the tip end 76 of the projecting pin 68 mounted on the lower side edge of the moving support 30 presses the lever or push piece 78 of the switch S2. An alarming lamp PL is connected in series with the contact *a* of this switch S2 through the normally open contact *b* of the relay contact R2-4. When paper jamming is caused to occur in the copying paper transfer passage *b* in the state that the copying paper 3 or 3′ is pressing the push piece 65 of the detecting switch mechanism S1, the moving support 30 is halted at the normal stop point, and since the normally open contact *b* of the switch S1 is opened at this time, the relay R2 is kept actuated and the normally open contact *b* is closed. Accordingly, the alarming lamp PL is connected to the electric source through the relay contact R2-4 and the switch S2 and is turned on to inform an operator of occurrence of paper jamming. The paper feed clutch C3 is connected to the normally closed contact *a* of the relay contact R2-4 through the switch PB, and when paper jamming is caused to occur, since the normally closed contact *a* of the relay contact R2-4 is opened, the paper feed clutch C3 is not actuated.

In the electrophotographic copying machine of this invention, as described above, the copying operation according to the method of the manual feeding of sheet-like copying paper can be performed by employing the manual feeding mechanism mounted independently from the mechanism of the automatic feeding of roll-like copying paper. In order to embody this feature, a switch S5 (switch for initiation of the copying operation) is disposed on the sheet-like copying paper transfer passage *b'* so that it is actuated when a sheet-like copying paper is manually fed. The normally closed contact *a* of this switch S5 is connected in series with a circuit including the paper feed clutch C3 and switch PB, and the on-delay relay R5 and the normally closed contact *a* of the relay contact R2-2 connected to the start solenoid M2 are connected in parallel to the switch S5 on the side of the normally open contact *b*. In the above structure, when a sheet-like copying paper is manually fed, the normally open contact *b* of the switch S5 is closed and the start solenoid M2 is actuated, whereby the moving support 30 is released from the restraint. Simultaneously, the normally open contact *b* of the relay contact R5-1 of the on-delay relay R5 is closed, to thereby apply an electric current to the clutch C1 through a relay contact R4-2 for switch-over of the moving direction of the moving support.

A relay contact R5-2 of the relay R5 is disposed in parallel to the relay contact R1-2 so that even when the switch S2 is opened by the movement of the moving support, the self-maintaining can be effected.

In the electrophotographic copying machine of this invention, as described above, the moving support 30 is halted at the stop point where the light exposure preparation step is terminated, and when the forward end of the copying paper is detected by the push piece 65 of the copy paper detecting mechanism to actuate the switch S1, the light exposure step of the moving support 30 is initiated by the actuation of the switch S1. In connection with this feature, it is desired that a light source L for the light exposure is at first turned on and after the quantity of light reaches a standard level, the light exposure step is initiated, whereby an undesired phenomenon that the light exposure is conducted in the state that the condition of the light source for the light exposure is unstable at the initial stage of lighting, namely in the state that the light quantity has not reached a standard level, can be effectively prevented. In order to embody this feature, as described above, the machine is so constructed that the light source L for the light exposure is connected to the electric source when the tip end 76 of the projecting lever 68 of the moving support presses the push piece 75 to close the normally open contact *b* of the switch S3. Since the speed $V_1'$ of the moving support 30 travelling in the reverse direction is higher than the speed $V_1$ of the moving support 30 travelling in the normal direction (the light exposure step speed) and since the copying paper transfer speed is synchronous with the light exposure feed step speed of the moving support, the arrival of the forward end of the copying paper at the actuation point of the push piece 65 of the first detecting mechanism lags behind the arrival of the tip end 76 of the projecting pin of the moving support at the push piece 75 of the switch S3 by a time expressed by the following formula:

$$t = lmin\ (1/V_1 - 1/V_1')$$

wherein $t$ indicates the time of delay, $lmin$, $V_1$ and $V_1'$ has the meaning as mentioned above. Accordingly, if the values of $V_1$ and $V_1'$ are appropriately chosen, it is made possible to initiate the light exposure step after a certain period, for instance, 0.3 to 1 second, has been passed from the lighting source and the light quantity has reached a standard stable level.

An alternating supply of electric current from upper and lower supply lines L1 and L2 is connected to the machine through master switch MS to operate the motor for the machine and also to energize the various other elements and controls therefor.

"Off delay" relay R1 is energized with a delayed reaction when the electromatic clutch C3 is connected to a source of power, a rectifier being connected to the coil of relay R1 through suitable switches from the upper supply line L1 and also being connected at its other terminal to the lower supply line L2. A resistance R and capacitance C are connected in series and the series combination of resistance R and capacitor C is in parallel with the coil of relay R1 of the "Off delay" type so that when the paper feed magnetic clutch C3 is energized the coil of relay R1 is simultaneously energized to operate the relay switches R1-1 and R1-2, etc.

When the circuit is broken so that clutch C3 no longer receives current from the supply lines, the charge that has accumulated on the capacitor C continues to energize the relay coil R1 for a definite time thereby maintaining the clutch C3 engaged for a definite predetermined time interval after the relay contact R3-1 is opened from contact *a* and closed with contact *b* in accordance with the capacity of the condenser C and resistance in the resistor R.

Relay R2 is operated in a similar manner

"On delay" relay R5 produces a time delay before energizing the coil of relay 5 since the resistor R is in series with the capacitor C and the coil of relay R5 so that when the circuit is closed a small current first charges the condenser until it is fully charged before the relay coil or relay R5 is energized to operate the relay R5 and the switches controlled thereby.

A high voltage source HV of the charging device is mounted between the contact *b* of the switch S2 and the electric source, and an electric current is being applied thereto while the moving support 30 is travelling.

Operations of mechanisms and members of the electrophotographic copying machine of this invention are performed in the following manner by an electric circuit shown in FIG. 7. I. In Case of Automatic Feeding of Roll-Like Copying Paper:

1. An input switch MS is closed to actuate a drive motor M.

2. A switch PB (switch for initiation of the copying operation) is closed to actuate a paper feed clutch C3 (initiation of feeding of copying paper). Simultaneously, an off-delay relay R1 is actuated to attain the self-maintaining of a relay contact R1-1. A relay contact R1-2 is closed to actuate a start solenoid M2 (release of a drive force for locking a moving support 30) through a normally closed contact *a* of a switch S1, a relay contact R1-2 and a relay contact R2-2. The relay contact R1-2 is closed to actuate an on-delay relay R5. After a delay of a certain period, a relay contact R5-1 is closed to actuate a clutch C1 for moving the moving support in the reverse direction (light exposure preparation step of the moving support 30) through a relay contact R5-1, a relay contact R2-3, a normally closed contact a of a switch S3 and a normally closed contact *a* of a relay contact R4-2. An electric source HV of a charging device is actuated through the relay contact R5-1 and the relay contact R2-3.

3. By the travel of the moving support 30, a contact *a* of a switch S2 is opened and a contact *b* of the switch S2 is closed, but the operation of the paper feed clutch C3 is continued by the self-maintaining of the relay contact R1-1.

4. The moving support 30 reaches the position of initiation of the light exposure step and a tip end 76 of a projecting lever 68 of the moving support 30 presses a push piece 75 of a switch S3. A normally closed contact *a* of the switch S3 is opened and the operation of the clutch C1 for moving the moving support 30 in the reverse direction is stopped (the moving support 30 is halted at this position and the light exposure preparation step is completed). A normally open contact *b* of the switch S3 is closed, and a light source L for the light exposure is turned on.

5. The forward end of copying paper 3 fed by the paper feed clutch C3 presses a push piece of copy paper detecting mechanism to actuate a switch S1. A normally open contact *b* of the switch S1 is closed to actuate an off-delay relay R2. A relay contact R2-1 is closed to actuate a relay R4 through a contact *b* of a switch S2, a contact *b* of the switch S3, the relay contact R2-1 and a switch S4. A relay contact R4-1 is closed to attain the self-maintaining of the relay R4, and therefore, even if the switch S3 is opened, the light source L is kept actuated. A contact *b* of a relay contact R4-2 and a relay contact R4-3 are closed, and a clutch C2 for moving the moving support 30 in the normal direction (the light exposure step of the moving support) is actuated through relay contacts R4-3 and R4-2. A normally open contact *b* of a relay contact R2-2 is closed, and the operation of the start solenoid M2 is continued.

6. The moving support 30 travels in the normal direction and a convex part 62 of a determining mechanism 60 presses a push piece 66 to close a switch S6. Both the normally open contact *b* of the switch S1 and the switch S6 are closed to actuate a relay R3. By actuation of the relay R3, a normally closed contact *a* of a relay contact R3-1 is opened to open the relay R1 and stop the operation of the paper feed clutch C3 (stopping of paper feeding). A normally open contact *b* of the relay contact R3-1 is closed to actuate cutter solenoid M1 (cutting of copying paper). The relay R1 is opened, and the relay contact R1-1 is opened after a delay of a short period by the off-delay system to release the self-maintaining of the relay R1.

7. The rear end of the copying paper passes through the position of the push piece 65 of the copy paper detecting mechanism, whereby the normally open contact *b*of the switch S1 is returned to the open state. The self-maintaining is attained on the relay R2 by an off-delay circuit of a resistance R and a condenser C until the rear end of the copying paper passes through the light exposure zone 6, and then the self-maintaining of the relay R2 is released. The relay contact R2-1 is opened and hence, the relay R4 is opened to open the self-maintaining contact R4-1, whereby the light source L for the light exposure is turned off (the light source is put out). By opening of the relay R4, the normally open contact *b* of the relay contact R4-2 is returned to the open state to stop the operation of the clutch C2 for travelling the moving support in the normal direction and return the normally closed contact *a* of the relay contact R4-2 to the closed state, whereby the clutch C1 for travelling the moving support in the reverse direction is actuated (the return travel of the moving support is initiated). The normally open contact *b* of the relay contact R2-2 is returned to the open state, the operation of the start solenoid M2 is stopped and a hinged piece 70 is returned to the normal position.

8. The moving support 30 travels in the reverse direction and presses the switch S2 to open the contact *b* thereof, whereby the operation of the clutch C1 for moving the moving support in the reverse direction is stopped. The projecting pin 68 mounted on the lower side edge of the moving support 30 is engaged with a notch 69 of the hinged or pivoted piece 70 to halt and lock the moving support 30. The contact *b* of the switch S2 is returned to the open dotted line state, the electric source HV for the charging device is turned off.

The copying operation is repeated by the procedures mentioned above. In case a plurality of copies are obtained continuously from one original, there is adopted such a mechanism that the switch PB is kept in the closed state after a prescribed number of copies are obtained. II. In Case of Automatic Feeding of Sheet-Like Copying Paper:

Since actuation of the cutting device and the cutting length-determining mechanism is omitted, the following changes are made but other procedures are quite the same in the above-mentioned case of the automatic feeding of roll-like copying paper.

(6′) When the switch S3 is closed in procedure (4) mentioned above or when the switch S1 is actuated in procedure (5) mentioned above, the switch S6 is simultaneously closed. Both the normally open contact *b* of the switch S1 and the switch S6 are closed to actuate the relay R3. By the actuation of the relay R3, the normally closed contact a of the relay contact R3-1 is opened to de-activate the relay R1 and stop the operation of the paper feed clutch C3 (stopping of copying paper feeding). In this case, the cutter solenoid M1 is not necessary. The relay R1 is opened to open the relay contact R1-1 and release the self-maintaining of the relay R1. In this case, it is not always necessary that the relay R1 should be an off-delay relay. III. In Case of Manual Feeding of Sheet-Like Copying Paper:

The copying operation is performed by the same procedures as in the above-mentioned case of automatic feeding of roll-like copying paper except that although the operation is initiated by pressing the switch PB to close it in the above-mentioned case of automatic feeding of roll-like copying paper, in this case, when a sheet-like copying paper is manually introduced into the sheet-like copying paper transfer passage *b′*, the operation of the machine is initiated.

(2′) When a sheet-like copying paper is manually inserted, a normally open contact *b* of a switch S5

(switch for starting the copying operation) is closed to actuate an on-delay relay R5. Simultaneously, a start solenoid M2 is actuated (unlocking of the moving support 30). After a delay of a certain period, a relay contact R5-1 is closed to actuate a clutch C1 for travelling the moving support in the reverse direction (initiation of the reverse direction movement of the moving support). An electric source HV for the charging device is actuated. Since the switch PB is not closed, the paper feed clutch C3, the cutter solenoid M1 and the relay R1 are is not actuated. Then, the copying operation is performed according to procedures (3) to (8) mentioned above.

In case the copying machine is used exclusively for manual feeding of sheet-copying paper, provision of switch PB, clutch C3, cutter solenoid M1, relay R1, relay contact R1-1 and relay contact R3-1 is unnecessary.

In each of the foregoing three cases, when the termination of the light exposure step and the initiation of the return travel are not effected in the moving support 30 by a trouble caused in the random return mechanism (the actuation of the switch S1 is not released), the tip end of the projecting lever 68 mounted on the lower side edge of the moving support presses the push piece 77 of the detecting mechanism to open the switch S4 and relay R4, whereby the relay contact R4-2 is returned to the open state. Accordingly, an electric current is applied to the reverse direction movement clutch C1 through the contact *b* of the switch S2, the contact a of the switch S3 and the contact *a* of the relay contact R4-2, and the light exposure step is terminated and the return travel of the moving support is initiated. Further, the relay contact R4-1 is opened and the light source L for the light exposure is turned off.

What we claim is:

1. A photocopy machine comprising a frame having an upper surface with front and rear ends, said upper surface of said frame having a light exposure opening including an introduction edge located generally centrally of said front and rear ends, a carriage for carrying an original document to be copied movably mounted on said frame between a start print position where one end of said carriage projects from one of said front and rear ends of said frame and a carriage return position where the other end of said carriage projects from the other of said front and rear ends of said frame, said carriage normally located in a home position intermediate said start print and return positions and spaced from each, carriage drive means for reciprocating said carriage along said frame, said carriage drive means having first clutch means for moving said carriage in a first direction and second clutch means for moving said carriage in a direction opposite said first direction, a carriage setting device adjacent said start print position including a rear stop switch means for deactivating said first clutch means so that the leading edge of said original document is positioned adjacent the introduction edge of said light exposure opening, pin means on said carriage for engaging said carriage setting device, a supply of copy paper, a copy paper feed means adjacent said supply, means within said frame defining a copy paper transport passage, a plurality of copy paper driving means along said passage to convey a copy paper from said copy paper feed means through said transport passage, said transport passage including copy paper cutting means, charging means, light exposure means having receiving and discharge ends, developing means, and fixing means, optical system means in said frame between said light exposure opening and said light exposure zone to focus an image of the original document onto said copy paper, copy initiating switch means for activating said first clutch means of said carriage drive means to move said carriage from the home position to the start print position and said copy paper feed means to initiate the transport of the copy paper through said transport passage, and copy paper detecting means mounted along said transport passage adjacent said receiving end of said light exposure means for detecting the presence of the copy paper, said copy paper detecting means including a copy paper detecting switch means for activating said second clutch means when a copy paper is present and causing said carriage to move from the start print position to the carriage return position, said paper cutting means being spaced from said copy paper detecting means by a predetermined distance, a length determining means mounted on said carriage, said length determining means being selectively adjustable along said carriage between a minimum position and a maximum position to indicate the length of the original paper carried thereby, said minimum position indicating a length of the original paper which is equal to said predetermined distance, means mounted along said upper surface of said frame for detecting said length determining means and including a length determining switch means, said means for detecting said determining means being normally in engagement with said length determining means to actuate said length determining switch means when said length determining means is adjusted to said minimum position and said carriage is at said start print position, means for connecting said copy paper cutting means with said copy paper detecting switch means and said length determining switch means so that said copy paper cutting means is actuated to cut the copy paper only when both said copy paper detecting switch means and said length determining switch means are actuated, whereby the image of the original paper on the moving carriage is cast upon the moving copy paper and the copy paper is cut into the length of the original paper.

2. The photocopy machine of claim 1 including a carriage detecting means mounted along said upper surface of said frame adjacent said home position including carriage detecting switch means for deactivating said first clutch means of said carriage drive means, restraint means mounted adjacent said carriage detecting means, said restraint means including a carriage engaging means to engage said pin means on said carriage, means for releasing said engaging means of said restraint means simultaneously with the actuation of said copy paper feed means by said copy initiation switch, and relay means for maintaining the actuation of said releasing means until the trailing end of the copy paper is detected by said copy paper detecting means thereby unactuating said copy paper detecting switch.

3. The structure of claim 2 in which said restraint means is hingedly mounted on said frame and said carriage engaging means includes a notch for cooperatively receiving said carriage pin means.

4. The structure of claim 1 in which said copy paper supply includes a roll of copy paper of indefinite length and means for selectively rotating said roll of copy paper.

5. The structure set forth in claim 1 wherein said development means includes a developing tank and copy paper guide members through said tank, said guide members being upwardly curved, said guide members including feed and discharge ends, whereby said transport passage is downwardly inclined on the feed end of said guide members and is upwardly inclined on the discharge end.

6. The structure of claim 1 in which each of said charging means and said light exposure means includes an upper and lower portion between which the copy paper is conveyed, said lower portion of each of said charging means and said light exposure means being removably mounted on said frame.

7. The photocopy machine set forth in claim 1 in which said optical system includes a light projecting means having a light source and a reflecting wall for projecting light to the original document, a light exposure guide plate for exposing copy paper to the light, at least one lens and one mirror for focusing an image of the original document on the surface of the copy paper, and fan means for circulating air from outside the machine through said light exposure opening and around said optical system.

8. The photocopy machine of claim 1 including clutch control relay means, said clutch control relay means having a normally open contact connecting said second clutch means therewith and a normally closed contact connecting said first clutch means therewith, said copy paper detecting switch means including an off delay relay means to close said normally open contact of said clutch control means and maintain the activation of said second clutch means until the trailing end of the copy paper passes through said discharge end of said light exposure means after which said normally open contact of said clutch control relay means is opened releasing said second clutch means and said normally closed contact of said clutch control relay is closed to operate said first clutch means in said first direction.

* * * * *